US009431166B2

(12) United States Patent
Shijo et al.

(10) Patent No.: US 9,431,166 B2
(45) Date of Patent: Aug. 30, 2016

(54) INDUCTOR AND METHOD OF MANUFACTURING THE SAME

(71) Applicant: KABUSHIKI KAISHA TOSHIBA, Minato-ku, Tokyo (JP)

(72) Inventors: Tetsu Shijo, Tokyo (JP); Tetsushi Okamoto, Kawasaki (JP); Masahiro Sakai, Hiratsuka (JP); Satoshi Hiroshima, Kawasaki (JP); Shuichi Obayashi, Yokohama (JP); Akiko Yamada, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 107 days.

(21) Appl. No.: 14/196,786

(22) Filed: Mar. 4, 2014

(65) Prior Publication Data

US 2014/0253275 A1 Sep. 11, 2014

(30) Foreign Application Priority Data

Mar. 6, 2013 (JP) ..... 2013-044023
Nov. 5, 2013 (JP) ..... 2013-229702

(51) Int. Cl.
*H01F 17/00* (2006.01)
*H01F 5/00* (2006.01)
*H01F 27/24* (2006.01)
(Continued)

(52) U.S. Cl.
CPC ..... *H01F 27/34* (2013.01); *H01F 27/022* (2013.01); *H01F 27/22* (2013.01); *H01F 38/14* (2013.01); *H01F 41/005* (2013.01); *H01F 41/06* (2013.01); *H01F 27/327* (2013.01); *H01F 41/127* (2013.01); *Y10T 29/49071* (2015.01)

(58) Field of Classification Search
CPC ..... H01F 27/40; H01F 27/402; H01F 27/34; H01F 38/14; H01F 41/127; B23K 3/0315; E21B 47/122; G01V 3/34; Y10T 29/49071
USPC ..... 336/105, 200, 233, 198, 83
See application file for complete search history.

(56) References Cited

U.S. PATENT DOCUMENTS 2,459,018 A * 1/1949 De Monte ..... H01F 27/022 174/546
3,813,507 A * 5/1974 Kesselring ..... H01H 33/02 218/65

(Continued)

FOREIGN PATENT DOCUMENTS

CN 1574122 A 2/2005
CN 1856848 A 11/2006

(Continued)

OTHER PUBLICATIONS

Extended European Search Report issued by the European Patent Office on Sep. 26, 2014, for European Patent Application No. 14156963.2.

(Continued)

*Primary Examiner* — Mangtin Lian
*Assistant Examiner* — Kazi Hossain
(74) *Attorney, Agent, or Firm* — Finnegan, Henderson, Farabow, Garrett & Dunner, L.L.P.

(57) ABSTRACT

According to an embodiment, there is an inductor, including: a magnetic core; a winding formed around the magnetic core; a first resin provided between turns of the winding; and a second resin covering the winding and the first resin, wherein the second resin has higher filler content than the first resin.

11 Claims, 11 Drawing Sheets

(51) Int. Cl.

| | |
|---|---|
| ***H01F 27/34*** | (2006.01) |
| ***H01F 38/14*** | (2006.01) |
| ***H01F 41/06*** | (2016.01) |
| ***H01F 27/02*** | (2006.01) |
| ***H01F 27/22*** | (2006.01) |
| ***H01F 41/00*** | (2006.01) |
| *H01F 27/32* | (2006.01) |
| *H01F 41/12* | (2006.01) |

(56) References Cited

U.S. PATENT DOCUMENTS

| | | | | |
|---|---|---|---|---|
| 5,313,037 | A | 5/1994 | Hansen et al. | |
| 5,374,907 | A * | 12/1994 | Orita | H01F 17/04 333/181 |
| 5,528,113 | A | 6/1996 | Boys et al. | |
| 5,821,638 | A | 10/1998 | Boys et al. | |
| 6,144,280 | A * | 11/2000 | Amada | H01F 17/045 29/602.1 |
| 6,198,373 | B1 * | 3/2001 | Ogawa | H01F 17/0033 336/83 |
| 6,348,850 | B1 * | 2/2002 | Kimura | H01F 17/045 336/200 |
| 7,427,909 | B2 | 9/2008 | Ono et al. | |
| 7,655,867 | B2 | 2/2010 | Schäfer | |
| 2003/0080844 | A1 * | 5/2003 | Nishikawa | H01F 3/14 336/178 |
| 2005/0076857 | A1 | 4/2005 | Ishikawa et al. | |
| 2006/0209487 | A1 | 9/2006 | Schmidt et al. | |
| 2007/0277994 | A1 * | 12/2007 | Schafer | H01F 27/322 174/105 R |
| 2009/0237195 | A1 * | 9/2009 | Zeng | H01F 27/006 336/196 |
| 2010/0143639 | A1 | 6/2010 | Le et al. | |
| 2010/0214049 | A1 * | 8/2010 | Park | H01F 27/325 336/170 |
| 2011/0285215 | A1 * | 11/2011 | Hatase | H01F 27/327 307/104 |
| 2012/0249282 | A1 * | 10/2012 | Sin | H01L 28/10 336/200 |
| 2012/0306608 | A1 * | 12/2012 | Takenaka | H05K 1/165 336/200 |
| 2012/0326831 | A1 * | 12/2012 | Suzuki | H01F 27/263 336/233 |
| 2014/0125439 | A1 | 5/2014 | Esseghir et al. | |

FOREIGN PATENT DOCUMENTS

| | | | |
|---|---|---|---|
| CN | 101540227 | A | 9/2009 |
| CN | 101663712 | A | 3/2010 |
| DE | 1 061430 | | 8/1958 |
| DE | 103 12 284 | A1 | 10/2004 |
| DE | 10 2004 012 482 | A1 | 10/2005 |
| EP | 1 385 181 | A1 | 1/2004 |
| EP | 1 486 993 | A1 | 12/2004 |
| GB | 2 345 799 | A | 7/2000 |
| JP | 2008-35634 | | 2/2008 |
| JP | 2011-229202 | | 11/2011 |
| JP | 2013-55229 | | 3/2013 |
| WO | WO 2005/091317 | A2 | 9/2005 |
| WO | WO 2008/127575 | A1 | 10/2008 |
| WO | WO 2012/158292 | A1 | 11/2012 |

OTHER PUBLICATIONS

Shijo, U.S. Appl. No. 14/081,591, filed Nov. 15, 2013.

Partial European Search Report issued by the European Patent Office on May 30, 2014, for European Patent Application No. 14156963.2.

Notification of the First Office Action issued by the State Intellectual Property Office of the People's Republic of China on Dec. 4, 2015, for Chinese Patent Application No. 201410078608.6, and English-language translation thereof.

Extended European Search Report issued by the European Patent Office on Sep. 28, 2015, for European Patent Application No. 15165666.7.

* cited by examiner

INDUCTOR AND METHOD OF MANUFACTURING THE SAME

CROSS-REFERENCE TO RELATED APPLICATIONS

This application is based upon and claims the benefit of priority from Japanese Patent Application No. 2013-044023, filed March 6 and No. 2013-229702, filed Nov. 5, 2013; the entire contents of which are incorporated herein by reference.

FIELD

Embodiments described herein relates to an inductor and a method of manufacturing the same.

BACKGROUND

Many recent apparatuses adopt wireless power transmission systems that wirelessly transmit electric power in a noncontact manner by using mutual inductance between a power transmitting coil and a power receiving coil. A power transmitting coil used in such a wireless power transmission system includes a ferrite core, a coil wire wound around the ferrite core, and a resin covering the ferrite core and the coil wire. The coil wire is a stranded wire having low loss, such as a Litz wire.

When the ferrite core with the Litz wire wound therearound is covered with the resin, a space between turns of the Litz wire or a vicinity of the Litz wire may not be filled with the resin, and a void (cavity) may be formed. If a void is formed in the resin, the electrical field can be concentrated in the void to produce a discharge, thereby causing a dielectric breakdown. In addition, there is a possibility that heat is not uniformly diffused, the thermal conductivity decreases, and the resin deteriorates.

DETAILED DESCRIPTION

According to an embodiment, there is an inductor, including: a magnetic core; a winding formed around the magnetic core; a first resin provided between turns of the winding; and a second resin covering the winding and the first resin, wherein the second resin has higher filler content than the first resin.

In the following, embodiments of the present invention will be described with reference to the drawings.

First Embodiment

Figure 1:
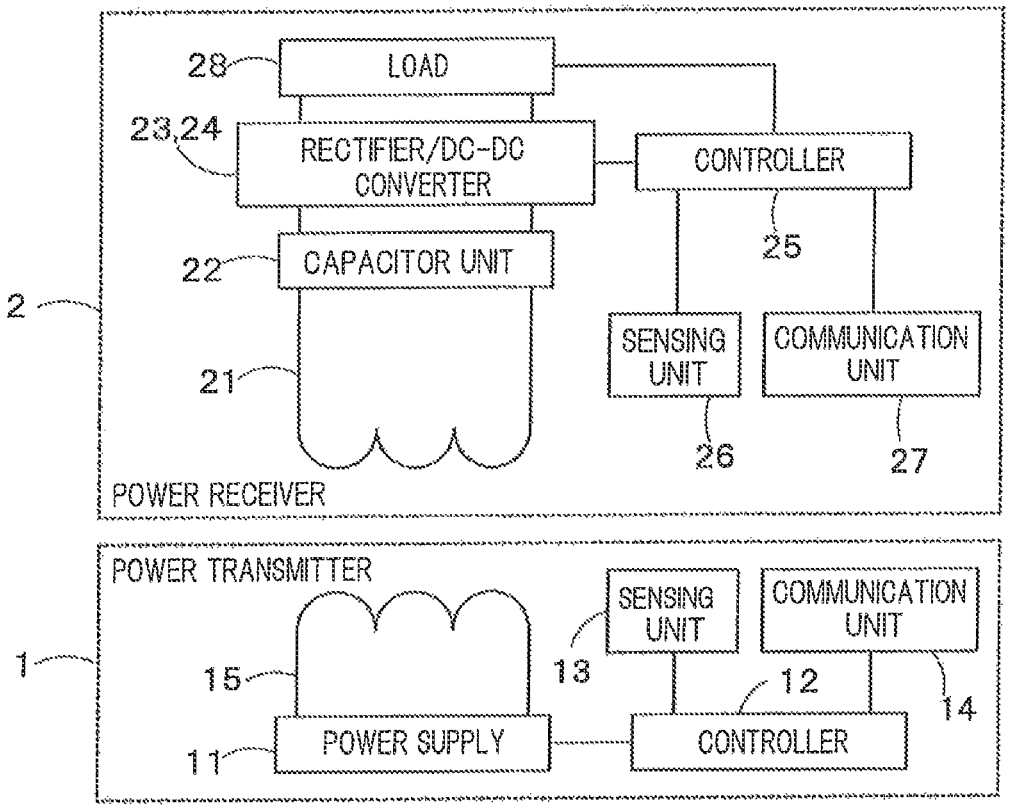
FIG. 1 is a block diagram showing a configuration of a wireless power transmission system according to a first embodiment.

FIG. 1 is a block diagram showing a configuration of a wireless power transmission system according to a first embodiment of the present invention. The wireless power transmission system includes a power transmitter 1 and a power receiver 2 to which electric power is wirelessly transmitted from the power transmitter 1. The power receiver 2 supplies the electric power transmitted thereto to a load 28 of an electrical apparatus. The power receiver 2 may be provided in the electric apparatus, integrated with the electric apparatus, or attached to the exterior of the main body of the electrical apparatus. For example, the electric apparatus may be a mobile terminal or an electric automobile, and the load 28 may be a rechargeable battery.

The power transmitter 1 includes a power supply 11 that converts a commercial electric power into an RF electric power suitable for electric power transmission, a controller 12 that controls the amount of required electric power and controls each component of the power transmitter 1, a sensing unit 13, a communication unit 14, and a power transmitting inductor 15. The sensing unit 13 includes at least one of a temperature sensor that monitors heat generation of the power transmitter 1, a temperature sensor that monitors heat of a foreign matter between the power transmitting inductor 15 and a power receiving inductor 21 described later, a sensor that monitors a foreign matter with an electromagnetic wave radar or an ultrasonic wave radar, a sensor that detects the position of the power receiving inductor 21, such as an RFID, and a sensor used in wireless power transmission between the power transmitter 1 and the power receiver 2, such as an ammeter or a voltmeter used for detecting the transmitted electric power, for example. The communication unit 14 is capable of communicating with a communication unit 27 in the power receiver 2 described later and receives a power reception status of the power receiver 2 or transmits a power transmission status of the power transmitter 1.

The power receiver 2 includes the power receiving inductor 21 that receives electric power from the power transmitting inductor 15 of the power transmitter 1 according to the mutual inductance between the two, a capacitor unit 22 connected to the power receiving inductor 21, a rectifier 23 that converts an alternating-current electric power received via the capacitor unit 22 to a direct-current electric power, a DC-DC converter 24 that changes a voltage conversion ratio based on an operating voltage of the load 28, a controller 25 that controls each component of the power receiver 2, a sensing unit 26, and the communication unit 27. In a case where the received electric power is controlled on the side of the power transmitter 1, the DC-DC converter 24 can be omitted.

The sensing unit 26 includes at least one of a temperature sensor that monitors heat generation of the power receiver 2, a temperature sensor that monitors heat of a foreign matter between the power receiving inductor 21 and the power transmitting inductor 15, a sensor that monitors a foreign matter with an electromagnetic wave radar or an ultrasonic wave radar, a sensor that detects the position of the power transmitting inductor 15, such as an RFID, and a sensor used in wireless power transmission between the power transmitter 1 and the power receiver 2, such as an ammeter or a voltmeter used for detecting the transmitted electric power, for example.

The communication unit 27 is capable of communicating with the communication unit 14 in the power transmitter 1 and transmits the power reception status of the power receiver 2 or receives the power transmission status of the power transmitter 1.

The controller 25 controls the received electric power (electric power supplied to the load 28) based on information acquired by the communication unit 27 communicating with the power transmitter 1 or a result of detection by the sensing unit 26.

Figure 2:
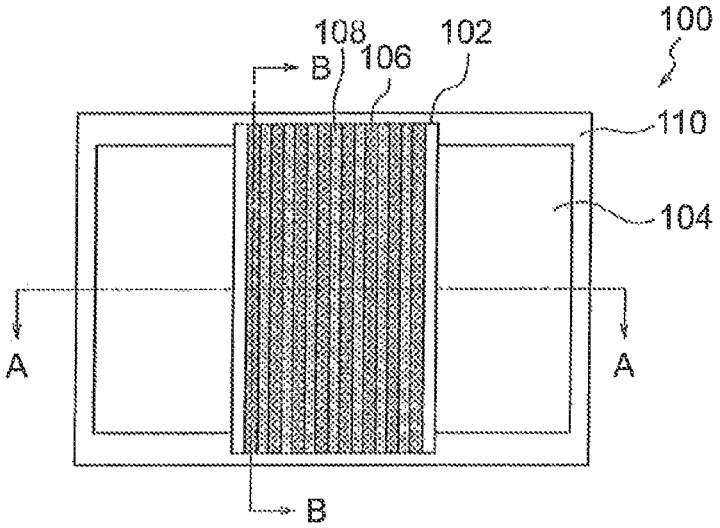
FIG. 2 is a top view of an inductor according to the first embodiment.
Figure 3:
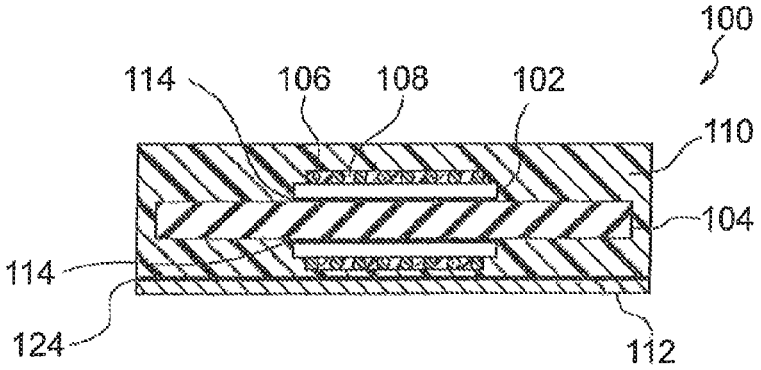
FIG. 3 is a cross-sectional view taken along the line A-A in FIG. 2.
Figure 4:
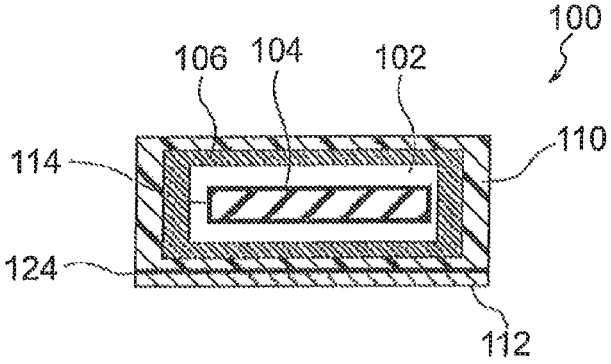
FIG. 4 is a cross-sectional view taken along the line B-B in FIG. 2.

FIG. 2 is a top view of an inductor 100 according to the first embodiment. For the convenience of explanation, other components that are actually hidden under a second resin 110 described later are also shown in the top view of FIG. 2. FIG. 3 is a vertical cross-sectional view taken along the line A-A in FIG. 2, and FIG. 4 is a vertical cross-sectional view taken along the line B-B in FIG. 2. The inductor 100 is used as the power transmitting inductor 15 and the power receiving inductor 21 shown in FIG. 1.

As shown in FIGS. 2 to 4, the inductor 100 includes a tubular bobbin 102, a ferrite core 104 inserted in a hole of the bobbin 102, a Litz wire (winding) 106 wound around an outer periphery of the bobbin 102, a first resin 108 that fills the spaces between the turns of the Litz wire 106, the second resin 110 that covers the bobbin 102, the ferrite core 104, the Litz wire 106 and the first resin 108, and a conductive plate 112 attached to one surface of the second resin 110. A conductive paint (conductive material) 114 having a lower rigidity than the bobbin 102 and the ferrite core 104 may be applied to an inner wall of the bobbin 102. The conductive paint 114 can prevent occurrence of a partial discharge in a space between the bobbin 102 and the ferrite core 104, because a potential difference occurs between the Litz wire 106 and the conductive paint 114 on the inside of the bobbin 102.

The bobbin 102 is made of a plastic, for example, and the Litz wire 106 is a copper wire, for example. The conductive paint (conductive material) 114 contains carbon, for example. The conductive plate 112 is an aluminum plate or a copper plate, for example.

The second resin 110 is an epoxy resin, for example, and contains an inorganic filler, such as silica, boron nitride, or aluminum nitride. On the other hand, the first resin 108 contains no filler or has lower filler content than the second resin 110. Therefore, the first resin 108 has higher flowability (lower viscosity) than the second resin 110 and can readily fill the spaces between the turns of the Litz wire 106.

In this way, formation of a void (cavity) between the turns of the Litz wire 106 and in the vicinity of the Litz wire 106 can be prevented. Since void formation is prevented, occurrence of a partial discharge and a dielectric breakdown can be prevented.

Since void formation is prevented, heat of the Litz wire 106 can be uniformly diffused. The second resin 110 covering the Litz wire 106 and the first resin 108 contains a filler and has high thermal conductivity and therefore can efficiently diffuse heat. Therefore, deterioration of thermal conductivity and deterioration of the resins caused thereby can be prevented.

Next, a method of manufacturing such an inductor 100 will be described. First, the Litz wire 106 is wound around the bobbin 102. In a space-filling process, the spaces between the turns of the Litz wire 106 are then filled with the first resin 108. Since the first resin 108 contains no filler or has extremely low filler content, the first resin 108 has high flowability (low viscosity) and can readily fill the spaces between the turns of the Litz wire 106. Therefore, the first resin 108 pervades the spaces between the turns of the Litz wire 106 and other minute regions, so that formation of a void can be prevented. Following the space-filling process, a heating process is performed to cure the first resin 108.

The conductive paint 114 may then be applied to an inner wall part of the bobbin 102. After that, the ferrite core 104 is inserted into the hole of the bobbin 102.

The assembly of the bobbin 102, the ferrite core 104 and the Litz wire 106 is then housed in a mold (container), and the second resin 110 is poured into the mold in a vacuum and cured.

The resulting assembly is then removed from the mold, and the conductive plate 112 is attached to one surface of the second resin 110. For example, the conductive plate 112 is applied to one surface of the second resin with a conductive paint (conductive material) 124 having lower rigidity than the conductive plate 112 interposed therebetween and fixed to the surface with a screw or the like. In this way, the inductor 100 shown in FIGS. 2 to 4 can be manufactured. The applied conductive paint 124 can prevent occurrence of a partial discharge between the second resin 110 and the conductive plate 112, because a potential difference occurs between the Litz wire 106 and the conductive paint 124. Since the conductive paint 124 having lower rigidity than the conductive plate 112 is inserted, a void can be prevented from being formed between the conductive plate 112 and the second resin 110 because of peel off of the resin caused by vibration.

By filling the spaces between the turns of the Litz wire 106 with the first resin 108 having high flowability, void formation can be prevented, dielectric breakdown due to a partial discharge can be prevented, and heat of the Litz wire 106 can be uniformly diffused. In addition, by covering the bobbin 102, the ferrite core 104 and the Litz wire 106 with the second resin 110 containing a filler and having high thermal conductivity, heat can be efficiently diffused, and deterioration of the resin can be prevented. In this way, the inductor according to this embodiment can be prevented from deteriorating in electric insulating properties and thermal conductivity.

In the embodiment described above, the conductive plate 112 is attached after the second resin 110 is cured. With such a configuration, the conductive plate 112 can be easily removed.

As an alternative, the conductive plate 112 may be housed in the mold (container) along with the bobbin 102, the ferrite core 104 and the Litz wire 106, and the second resin 110 may be then poured into the mold and cured. In that case, the adhesion between the conductive plate 112 and the second resin 110 can be improved.

As an alternative, the mold (container) may be a plastic case, which can be used as a housing of the inductor 100. In that case, the step of removing the cured second resin 110 from the mold (container) can be omitted.

If the filling rate of the filler, such as boron nitride or aluminum nitride, in the second resin 110 is increased, the thermal conductivity can be further improved.

Second Embodiment

Figure 5:
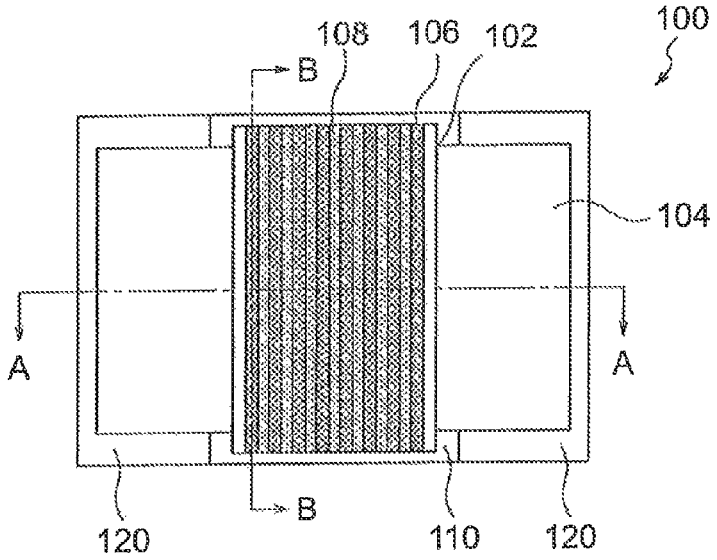
FIG. 5 is a top view of an inductor according to a second embodiment.
Figure 6:
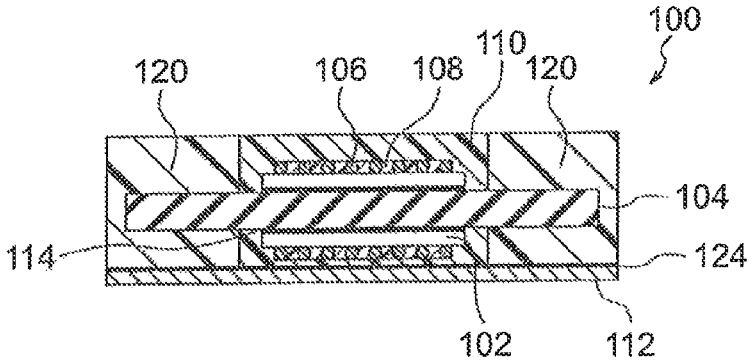
FIG. 6 is a cross-sectional view taken along the line A-A in FIG. 5.
Figure 7:
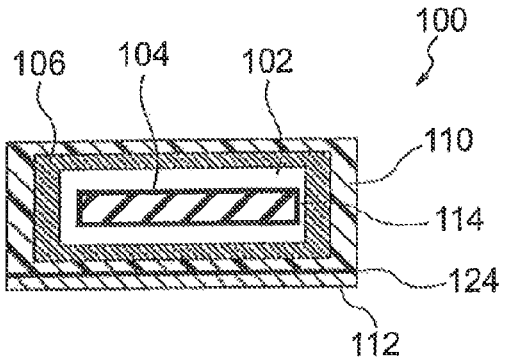
FIG. 7 is a cross-sectional view taken along the line B-B in FIG. 5.

FIGS. 5 to 7 show a schematic configuration of an inductor according to a second embodiment of the present invention. FIG. 5 is a top view of the inductor according to this embodiment, FIG. 6 is a vertical cross-sectional view taken along the line A-A in FIG. 5, and FIG. 7 is a vertical cross-sectional view taken along the line B-B in FIG. 5.

This embodiment differs from the first embodiment shown in FIGS. 2 to 4 in that the second resin 110 is provided around the Litz wire 106, and the second resin 110 is disposed between third resins 120 having lower filler content than the second resin 110. In FIGS. 5 to 7, the same components as those in the first embodiment shown in FIGS. 2 to 4 are denoted by the same reference numerals, and descriptions thereof will be omitted.

According to this embodiment, the second resin 110 having higher filler content is provided in a region surrounding the Litz wire 106. End parts of the ferrite core 104 in a direction (horizontal direction in FIGS. 5 and 6) perpendicular to the direction of winding of the Litz wire 106 are covered with the third resins 120 having lower filler content than the second resin 110. The filler content of the third resin 120 is approximately equal to or higher than the filler content of the first resin 108.

Since the Litz wire 106, which is a heat generation source of the inductor 100, is covered with the second resin 110 having higher filler content and higher thermal conductivity, heat of the Litz wire 106 can be efficiently diffused. In addition, since the third resins 120 having lower filler content and higher flowability are provided in parts spaced apart from the Litz wire 106, formation of a void can be prevented. Since the filler content is lower, the weight of the inductor 100 can be reduced accordingly.

Next, a method of manufacturing the inductor according to this embodiment will be described. First, the Litz wire 106 is wound around the bobbin 102. In a space-filling process, the spaces between the turns of the Litz wire 106 are then filled with the first resin 108. Since the first resin 108 contains no filler or has extremely low filler content, the first resin 108 has high flowability (low viscosity) and can readily fill the spaces between the turns of the Litz wire 106. Therefore, the first resin 108 pervades the spaces between the turns of the Litz wire 106 and other minute regions, so that formation of a void can be prevented. Following the space-filling process, a heating process is performed to cure the first resin 108.

The conductive paint 114 is then applied to the inner wall part of the bobbin 102, and the ferrite core 104 is inserted into the hole of the bobbin 102.

Figure 8:
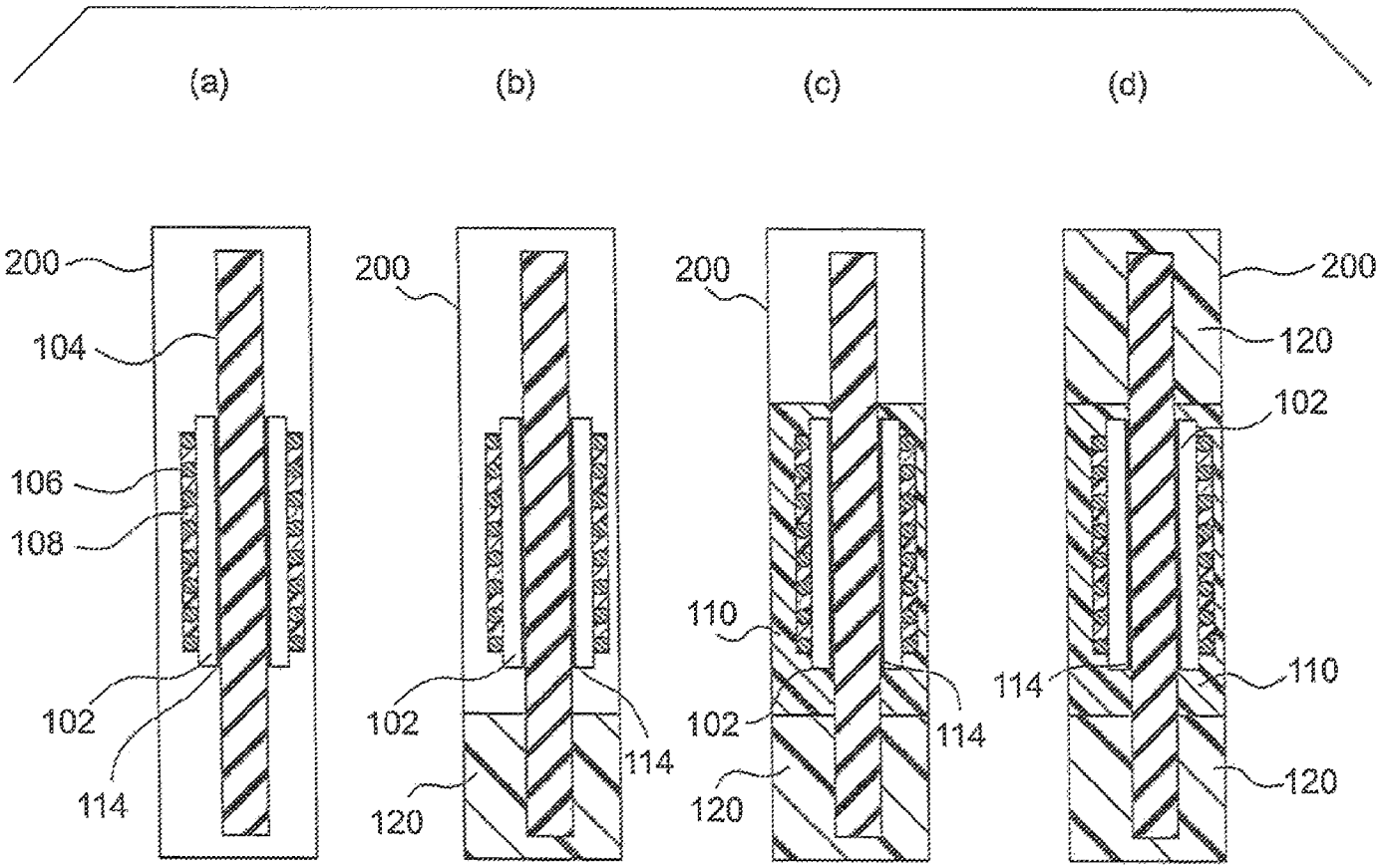
FIG. 8 shows process cross-sectional views for illustrating a method of manufacturing the inductor according to the second embodiment.

The assembly of the bobbin 102, the ferrite core 104 and the Litz wire 106 is then housed in a mold 200 shown in FIG. 8(*a*). In this step, the assembly is placed in the mold 200 with one end of the ferrite core 104 in the direction perpendicular to the direction of winding of the Litz wire 106 located at the bottom and the other end located at the top. As shown in FIG. 8(*b*), the third resin 120 is then poured to a level slightly below the bobbin 102 and cured. As shown in FIG. 8(*c*), the second resin 110 is poured until the bobbin 102 is covered, and cured. As shown in FIG. 8(*d*), the third resin 120 is then poured again and cured.

The resulting assembly is then removed from the mold 200, and the conductive plate 112 is attached to one surface of the second resin 110 and the third resins 120. In this way, the inductor 100 shown in FIGS. 5 to 7 can be manufactured.

According to this embodiment, as in the first embodiment described above, by filling the spaces between the turns of the Litz wire 106 with the first resin 108 having high flowability, void formation can be prevented, dielectric breakdown due to a partial discharge can be prevented, and heat of the Litz wire 106 can be uniformly diffused. In addition, by covering the Litz wire 106 (bobbin 102) with the second resin 110 containing a filler and having high thermal conductivity, heat can be efficiently diffused, and deterioration of the resin can be prevented.

In addition, by covering the end parts of the ferrite core 104 spaced apart from the Litz wire 106 with the third resins 120 having higher flowability, void formation can be prevented, and dielectric breakdown due to a partial discharge can be prevented. In addition, the weight of the inductor can be reduced compared with the first embodiment described above.

Third Embodiment

Figure 9:
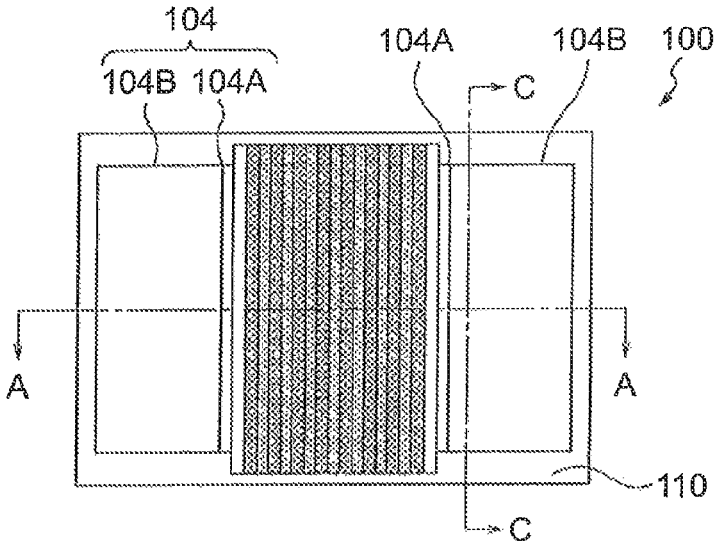
FIG. 9 is a top view of an inductor according to a third embodiment.
Figure 10:
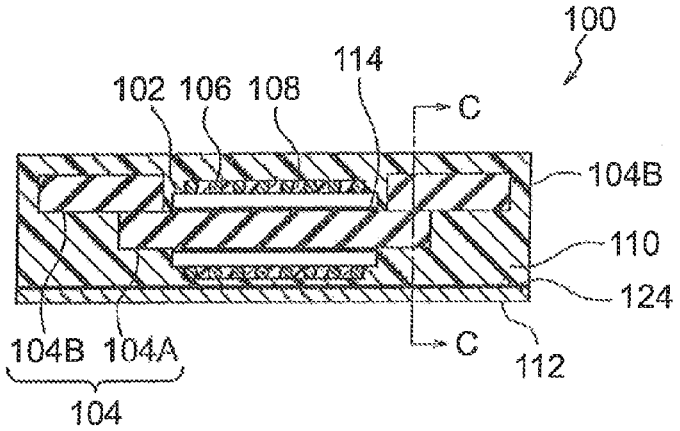
FIG. 10 is a cross-sectional view taken along the line A-A in FIG. 9.
Figure 11:
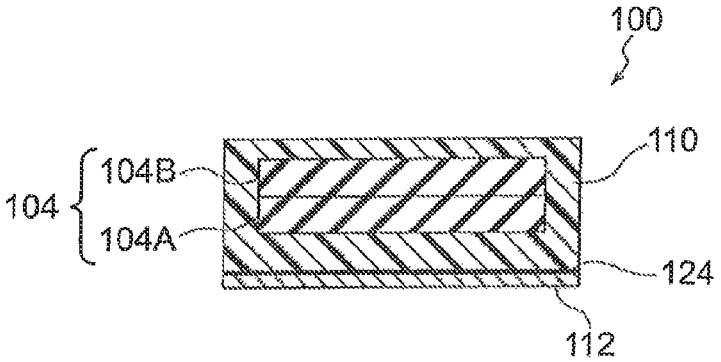
FIG. 11 is cross-sectional view taken along the line c-c in FIG. 9.

FIGS. 9 to 11 show a schematic configuration of an inductor according to a third embodiment of the present invention. FIG. 9 is a top view of the inductor according to this embodiment, FIG. 10 is a vertical cross-sectional view taken along the line A-A in FIG. 9, and FIG. 11 is a vertical cross-sectional view taken along the line C-C in FIGS. 9 and 10.

This embodiment differs from the first embodiment shown in FIGS. 2 to 4 in that the ferrite core has a two-layer structure. In FIGS. 9 to 11, the same components as those in the first embodiment shown in FIGS. 2 to 4 are denoted by the same reference numerals, and descriptions thereof will be omitted.

As shown in FIGS. 9 to 11, the ferrite core 104 includes a first core 104A inserted in the hole of the bobbin 102 and second cores 104B provided at end parts of the first core 104A in the length direction. Note that the length direction is a direction perpendicular (horizontal direction in FIGS. 9 and 10) to the direction of winding of the Litz wire 106. The second cores 104B are disposed on the opposite side of the first core 104A to the conductive plate 112.

The outer end parts of the second cores 104B in the length direction are positioned closer to the respective inductor end faces than the respective end parts of the first core 104A in the length direction. In other words, the second cores 1043 are disposed to protrude from the first core 104A.

Since the ferrite core 104 has a two-layer structure, the distance to the inductor of the counterpart device involved with the wireless power transmission can be reduced, and the coupling coefficient between the inductors can be increased.

In FIGS. 9 to 11, the first core 104A and the second cores 104B have the same width (width in the vertical direction in FIG. 9 or width in the horizontal direction in FIG. 11). As an alternative, however, the second cores 104B may have a width larger than the width of the first core 104A. Since the coupling coefficient between coils is proportional to the outer width of the coils, the coupling coefficient between the coils can be increased by increasing the width of the second cores 104B.

Fourth Embodiment

Figure 12:
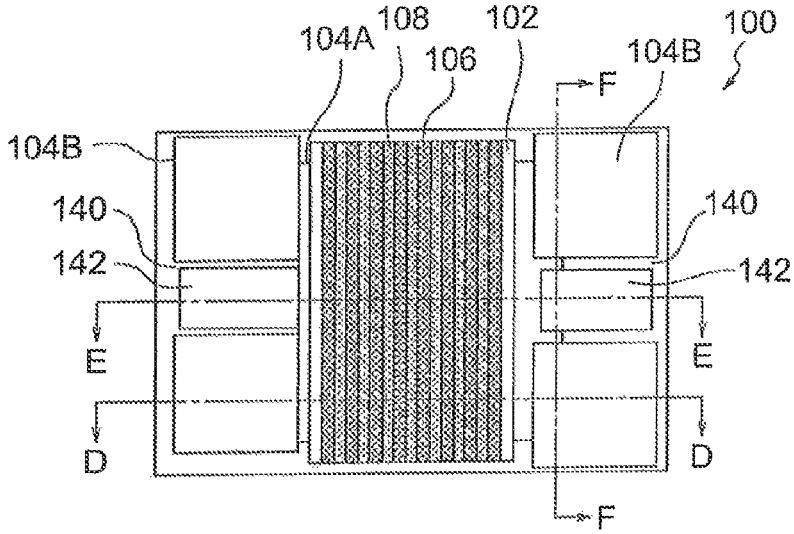
FIG. 12 is a top view of an inductor according to a fourth embodiment.
Figure 13:
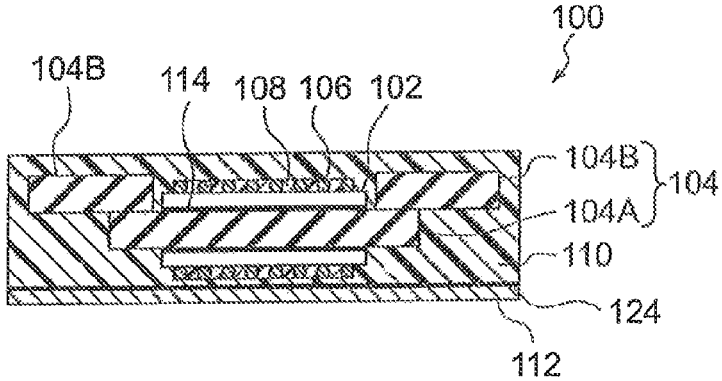
FIG. 13 is a cross-sectional view taken along the line D-D in FIG. 12.
Figure 14:
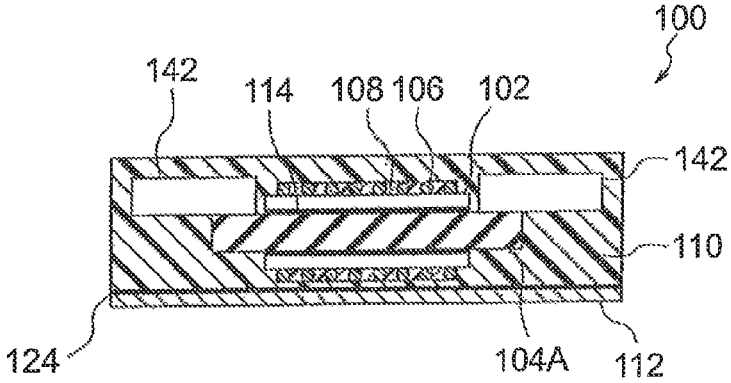
FIG. 14 is a cross-sectional view taken along the line E-E in FIG. 12.
Figure 15:
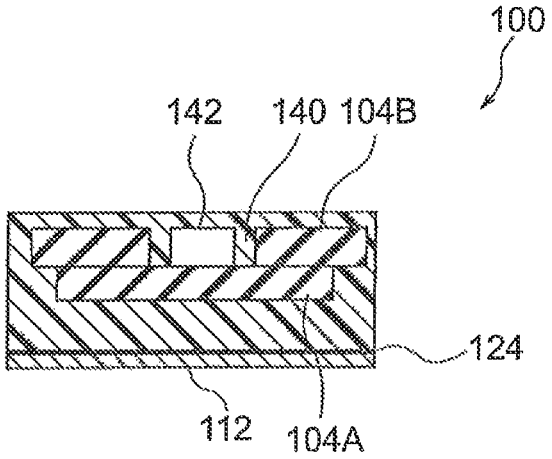
FIG. 15 is a cross-sectional view taken along the line F-F in FIG. 12.

FIGS. 12 to 15 show a schematic configuration of an inductor according to a fourth embodiment of the present invention. FIG. 12 is a top view of the inductor according to this embodiment, FIG. 13 is a vertical cross-sectional view taken along the line D-D in FIG. 12, FIG. 14 is a vertical cross-sectional view taken along the line E-E in FIG. 14, and FIG. 15 is a vertical cross-sectional view taken along the line F-F in FIG. 12.

This embodiment differs from the third embodiment shown in FIGS. 9 to 11 in that the second cores (upper layer cores) 104B of the ferrite core 104 have a gap 140 at the center thereof in the width direction, and a capacitor 142 is disposed in the gap 140. The capacitor 142 is the capacitor unit 22 shown in FIG. 1, for example. In FIGS. 12 to 15, the same components as those in the third embodiment shown in FIGS. 9 to 11 are denoted by the same reference numerals, and descriptions thereof will be omitted. Note that the configuration according to this embodiment can be applied to the first and second embodiments described earlier.

As the distance from an end face of the ferrite core 104 in the length direction of the ferrite core 104 increases, the electromagnetic field becomes weaken Although the electromagnetic field also becomes weaker as the distance from the ferrite core 104 in the width direction of the ferrite core 104 increases, the degree to which the electromagnetic field becomes weaker is greater when the distance from the ferrite core 104 in the length direction increases.

Since the gaps 140 are formed at positions spaced apart from each other in the length direction of the ferrite core 104, the weight of the ferrite core 104 can be reduced while reducing the influence on the electrical characteristics (characteristics of the coupling with the inductor of the opposite wireless power transmission device, for example) of the inductor 100. In addition, the capacitors 142 can be disposed in the gaps 140. That is, the capacitors 142 can be incorporated in the inductor 100. As a result, the size of the entire inductor can be reduced. The magnetic field of the inductor 100 is concentrated in a part where the ferrite core 104 exists. By forming the gaps 140, the magnetic field in the parts where the gaps 140 exist can be weakened.

In the fourth embodiment, in addition to the capacitors 142, rectifiers (rectifiers 23 in FIG. 1, for example) can also be disposed in the gaps 140.

In the first to fourth embodiments described above, the bobbin 102 has a flat outer periphery. As an alternative, however, recesses and projections may be formed on the outer periphery of the bobbin 102, and the Litz wire 106 can be disposed in the recesses. Since the first resin 108 has high flowability, the first resin 108 can pervade minute regions between the recesses on the bobbin 102 and the Litz wire 106 and prevent void formation.

Figure 16:
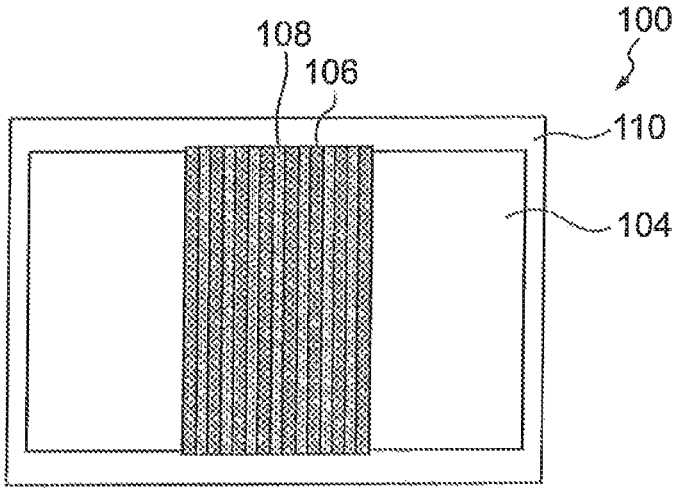
FIG. 16 is a top view of an inductor according to a modification.

In the first to fourth embodiments described above, the Litz wire 106 is wound around the ferrite core 104 with the bobbin 102 interposed therebetween. As an alternative, however, as shown in FIG. 16, the bobbin 102 may be omitted, and the Litz wire 106 may be directly wound around the ferrite core 104.

Fifth Embodiment

Figure 17:
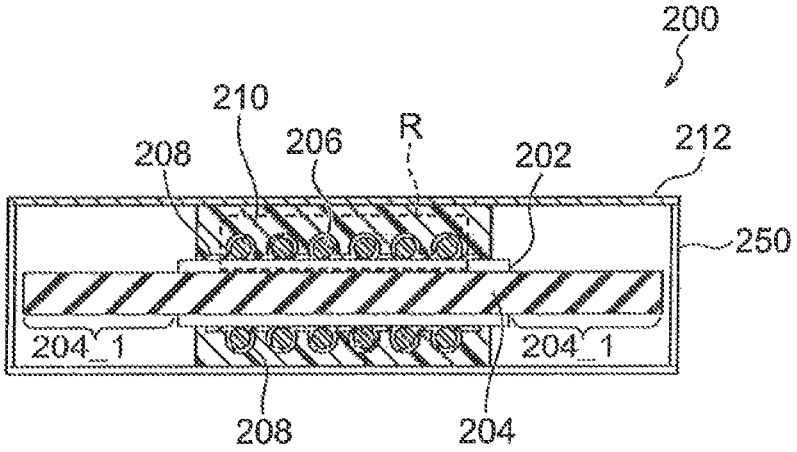
FIG. 17 is a top view of an inductor according to a fifth embodiment.
Figure 18:
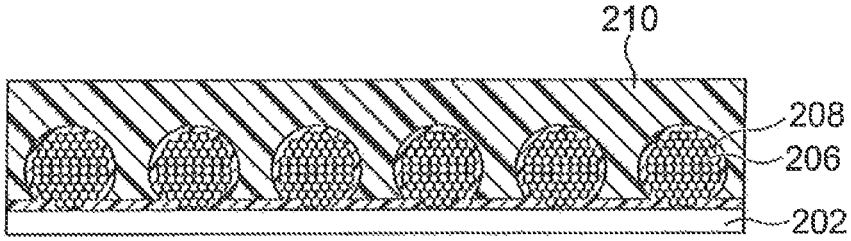
FIG. 18 is an enlarged view of a region "R" surrounded by the dashed line in FIG. 17.

FIGS. 17 and 18 show a schematic configuration of an inductor according to a fifth embodiment of the present invention. FIG. 17 is a vertical cross-sectional view of the inductor according to this embodiment, and FIG. 18 is an enlarged view of a region "R" surrounded by the dashed line in FIG. 17.

As shown in FIGS. 17 and 18, an inductor 200 includes a tubular bobbin 202, a ferrite core 204 inserted in a hole of the bobbin 202, a Litz wire (winding) 206 formed by a stranded wire of conductive strands wound around an outer periphery of the bobbin 202, a first resin 208 that fills the spaces between the turns of the Litz wire 206 and covers the periphery of the Litz wire 206, a second resin 210 that covers the bobbin 202 and the first resin 208, and a conductive plate 212 attached to one surface of the second resin 210. The inductor 200 is housed in a housing 250 made of a thermoplastic resin, such as polyphenylene sulfide (PPS).

The bobbin 202 is made of a plastic, for example, and the Litz wire 206 is formed by a stranded wire of copper strands, for example. The conductive plate 212 is an aluminum plate or a copper plate, for example.

The second resin 210 is an epoxy resin, for example, and contains an inorganic filler, such as silica, boron nitride, or aluminum nitride. On the other hand, the first resin 208 contains no filler or has lower filler content than the second resin 210. Therefore, the first resin 208 has higher flowability (lower viscosity) than the second resin 210 and can readily fill the spaces between the turns of the Litz wire 206.

In this way, formation of a void (cavity) between the turns of the Litz wire 206 and in the surroundings of the Litz wire 206 can be prevented. Since void formation is prevented, occurrence of a partial discharge and a dielectric breakdown can be prevented.

Since void formation is prevented, heat of the Litz wire 206 can be uniformly diffused. The second resin 210 covering the Litz wire 206 and the first resin 208 contains a filler and has high thermal conductivity and therefore can efficiently diffuse heat. Therefore, deterioration of thermal conductivity and deterioration of the resins caused thereby can be prevented.

The second resin 210 has only to cover at least the Litz wire 206 (in other words, the first resin 208 covering the Litz wire 206). Therefore, as shown in FIG. 17, the second resin 210 does not have to cover parts 204_1 of the ferrite core 204 that protrude from the hole of the bobbin 202. In other words, the second resin 210 does not have to cover the end parts 204_1, whose surfaces are exposed, in the length direction of the ferrite core 204 (direction perpendicular to the direction of winding of the Litz wire 206). By selectively providing the second resin 210 only in the surroundings of the Litz wire 206, which tends to generate heat, weight increase of the inductor 200 can be reduced while maintaining the heat dissipation capability.

Next, a method of manufacturing such an inductor 200 will be described with reference to FIG. 19(*a*) to (*e*).

Figure 19:
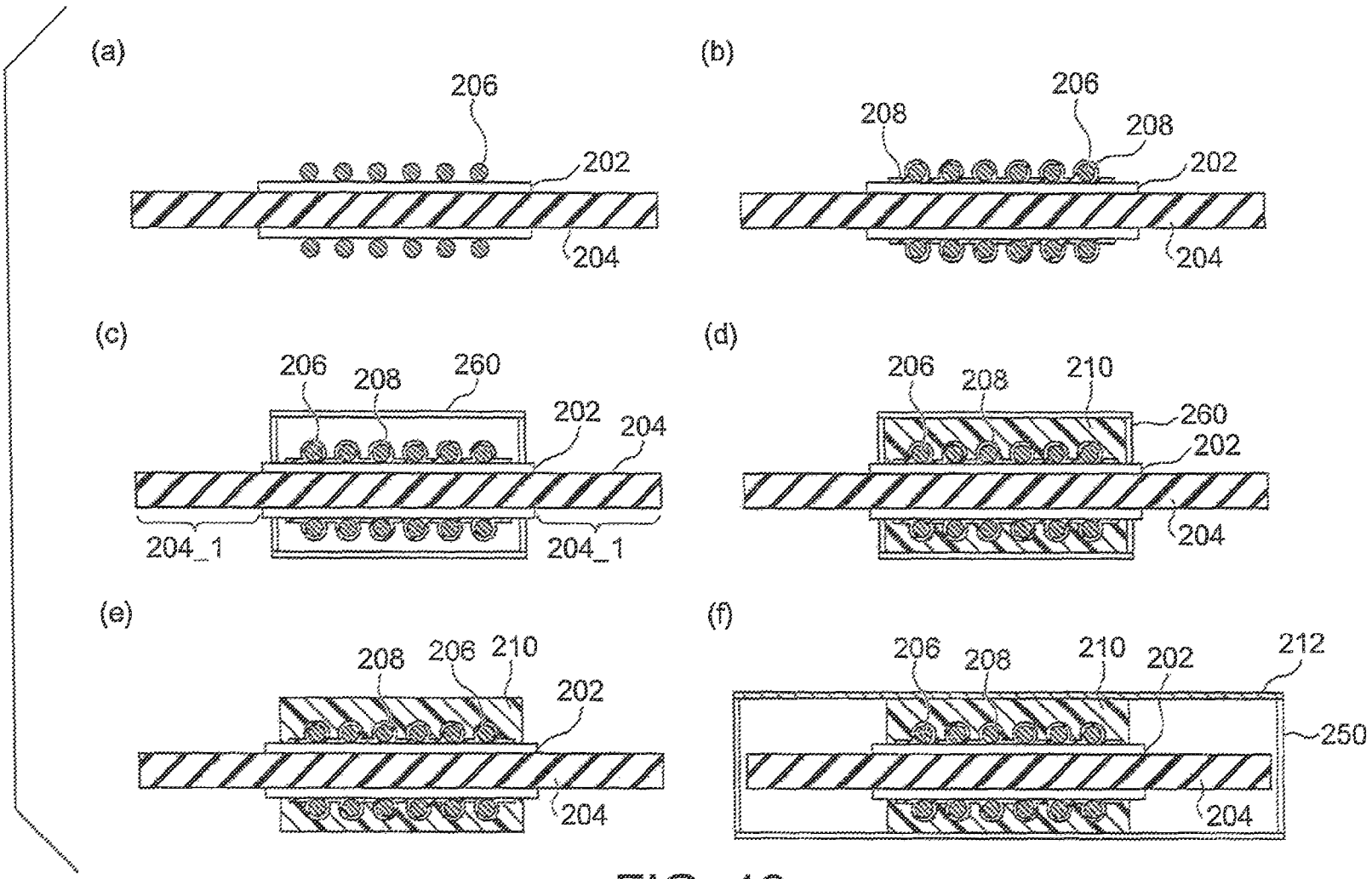
FIG. 19 shows process cross-sectional views for illustrating a method of manufacturing the inductor according to the fifth embodiment.

First, as shown in FIG. 19(*a*), the ferrite core 204 is inserted into the hole of the bobbin 202. The Litz wire 206 is then wound around the bobbin 202.

As shown in FIG. 19(*b*), in a space-filling process, the spaces between the turns of the Litz wire 206 are then filled with the first resin 208. The first resin 208 is also applied to the surroundings of the Litz wire 206 and the surface of the bobbin 202. Since the first resin 208 contains no filler or has extremely low filler content, the first resin 208 has high flowability (low viscosity) and can readily fill the spaces between the turns of the Litz wire 206. Therefore, the first resin 208 pervades the spaces between the turns of the Litz wire 206 and other minute regions, so that formation of a void can be prevented. Following the space-filling process, a heating process is performed to cure the first resin 208.

As shown in FIG. 19(*c*), a mold (container) 260 is then provided to cover the Litz wire 206 and the first resin 208 but not to cover the end parts 204_1 of the ferrite core 204. As shown in FIG. 19(*d*), the second resin 210 is then poured into the mold 260 and cured. After the second resin 210 is cured, the mold 260 is removed. In this way, the second resin 210 can be selectively provided only around the Litz wire 206 as shown in FIG. 19(*e*).

As shown in FIG. 19(*f*), the conductive plate 212 is then attached to one surface of the second resin 210, and the resulting assembly is housed in the housing 250. In this way, the inductor 200 shown in FIG. 17 can be manufactured.

In order to facilitate winding of the Litz wire 206 around the bobbin 202 and filling of the spaces between the turns of the Litz wire 206 with the first resin 208, the Litz wire 206 may be covered with an insulating material having a surface with a hole or a mesh of insulating material. For example, the Litz wire 206 may be covered with a heat-shrinkable tube having a surface with a hole.

In the method of manufacturing the inductor 200 shown in FIG. 19(*a*) to (*f*), the ferrite core 204 is inserted into the hole of the bobbin 202 before the Litz wire 206 is wound around the bobbin 202. However, insertion of the ferrite core 204 can be performed at any time before the assembly is housed in the housing 250.

As an alternative, the ferrite core 204 may be provided by separately preparing the part to be housed in the hole of the bobbin 202 and the parts to protrude from the hole of the bobbin 202 (the end parts 204_1 in FIG. 17) and retrofitting the end parts 204_1 to the part in the hole. A method of manufacturing the inductor 200 in the case where the end parts 204_1 of the ferrite core 204 are retrofitted will be described with reference to FIG. 20(*a*) to (*f*).

Figure 20:
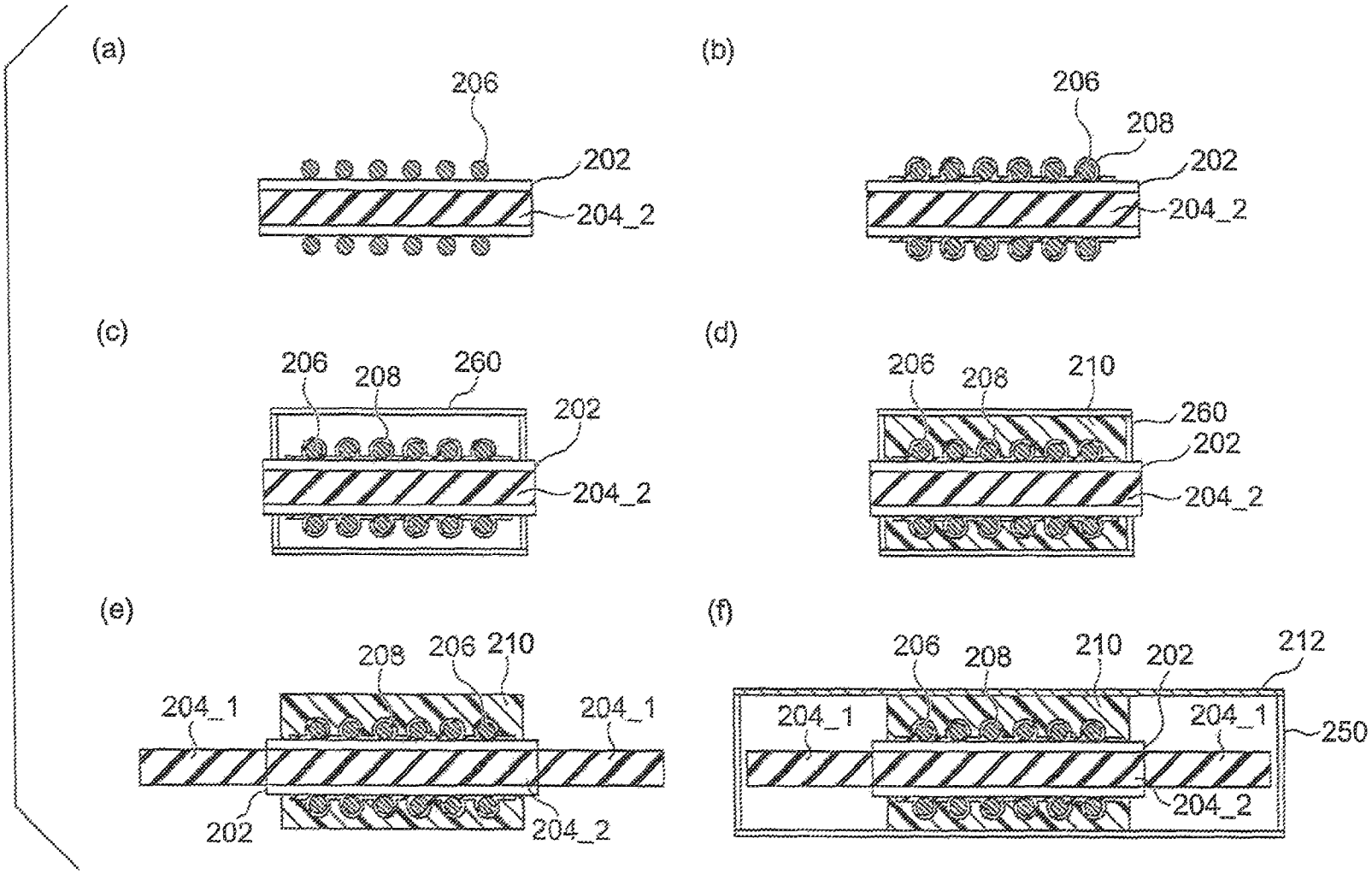
FIG. 20 shows process cross-sectional views for illustrating a method of manufacturing an inductor according to a modification of the fifth embodiment.

First, as shown in FIG. 20(*a*), a ferrite core 204_2 having approximately the same length as the bobbin 202 is inserted into the hole of the bobbin 202. The Litz wire 206 is then wound around the bobbin 202.

As shown in FIG. 20(*b*), in a space-filling process, the spaces between the turns of the Litz wire 206 are then filled with the first resin 208, and a heating process is performed to cure the first resin 208. This step is the same as the step shown in FIG. 19(*b*).

As shown in FIG. 20(*c*), the mold (container) 260 is then provided to cover the Litz wire 206 and the first resin 208. The mold 260 preferably has such a size that the end parts of the bobbin 202 are exposed.

As shown in FIG. 20(*d*), the second resin 210 is then poured into the mold 260 and cured. After the second resin 210 is cured, the mold 260 is removed.

As shown in FIG. 20(*e*), the end parts 204_1 of the ferrite core 204 are then bonded to both the end faces of the ferrite core 204_2.

As shown in FIG. 20(*f*), the conductive plate 212 is then attached to one surface of the second resin 210, and the resulting assembly is housed in the housing 250. In this way, the inductor 200 shown in FIG. 17 can also be manufactured in the manner in which the end parts 204_1 of the ferrite core 204 are retrofitted.

Figure 21:
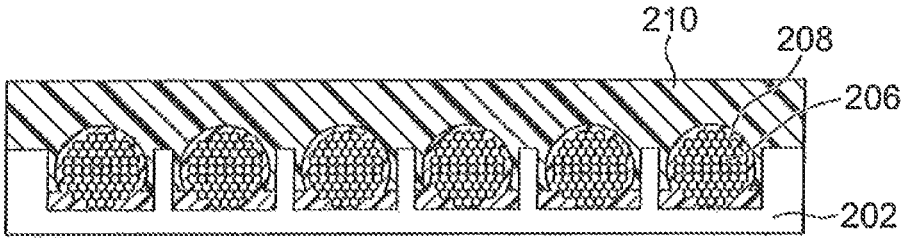
FIG. 21 is a diagram showing a surface of a bobbin according to the modification of the fifth embodiment.

In the fifth embodiment described above, as shown in FIG. 21, recesses and projections may be formed on the surface of the bobbin 202, and the Litz wire 206 can be disposed in the recesses.

Figure 22:
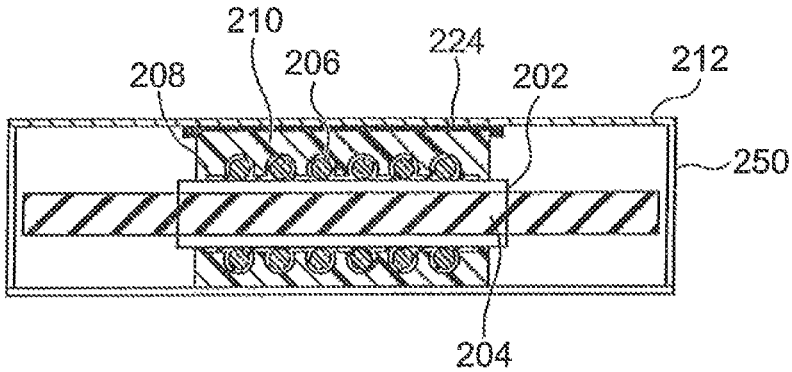
FIG. 22 is a cross-sectional view of the inductor according to the modification of the fifth embodiment.

In the fifth embodiment described above, as shown in FIG. 22, the conductive plate 212 may be attached to one surface of the second resin 210 with a conductive paint (conductive material) 224 having lower rigidity than the conductive plate 212 interposed therebetween. The applied conductive paint 224 can prevent occurrence of a partial discharge between the second resin 210 and the conductive plate 212, because a potential difference occurs between the Litz wire 206 and the conductive paint 224. In addition, since the conductive paint 224 having lower rigidity than the conductive plate 212 is inserted, a void can be prevented from being formed between the conductive plate 212 and the second resin 210 because of peel off of the resin caused by vibration.

Figure 23:
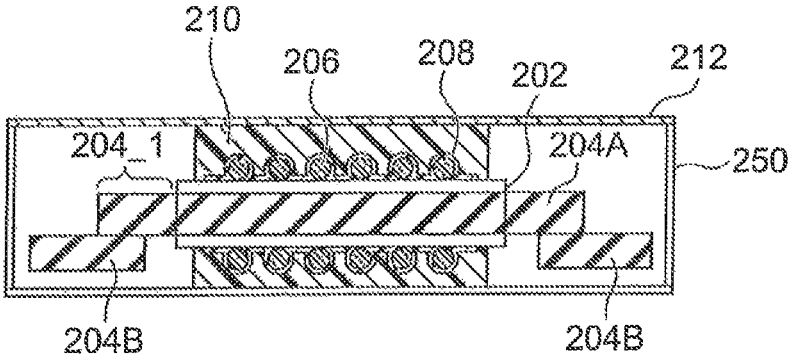
FIG. 23 is a cross-sectional view of the inductor according to the modification of the fifth embodiment.

As shown in FIG. 23, the ferrite core may have a two-layer structure. As shown in FIG. 23, the ferrite core 204 includes a first core 204A inserted in the hole of the bobbin 202 and second cores 204B provided at opposite end parts (end parts 204_1) of the first core 204A in the length direction. Note that the length direction is a direction perpendicular (horizontal direction in the drawing) to the direction of winding of the Litz wire 206. The second cores 204B are disposed on the opposite side of the first core 204A to the conductive plate 212.

The outer end parts of the second cores 204B in the length direction are positioned closer to the respective inner walls of the housing 250 than the respective end parts of the first core 204A in the length direction. In other words, the second cores 204B are disposed to protrude from the first core 204A.

Since the ferrite core 204 has a two-layer structure, the distance between the ferrite surface and the inductor of the counterpart device involved with the wireless power transmission can be reduced, and the coupling coefficient between the inductors can be increased.

The Litz wire 106 and the first resin 108 in the first to fourth embodiments described earlier may be configured in the same way as the Litz wire 206 and the first resin 208 in this fifth embodiment.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. An inductor, comprising:

a magnetic core;

a winding formed around the magnetic core;

a first resin provided between turns of the winding;

a second resin covering the winding and the first resin; and a conductive plate provided on one surface of the second resin, wherein the second resin has higher filler content than the first resin, and the conductive plate is attached to the second resin with a conductive material having lower rigidity than the conductive plate interposed therebetween.

2. The inductor according to claim 1, wherein the winding is formed by a stranded wire of a plurality of conductive strands, and the first resin fills an interior of the winding.

3. The inductor according to claim 1, wherein the winding is covered with an insulating material having a surface with a hole or a mesh of insulating material.

4. The inductor according to claim 1, wherein both end parts of the magnetic core in a direction perpendicular to a direction of winding of the winding have an exposed surface.

5. The inductor according to claim 1, wherein a part of the magnetic core within a predetermined distance from the winding is covered with the second resin, parts of the magnetic core beyond the predetermined distance are covered with a third resin, and the third resin has lower filler content than the second resin.

6. The inductor according to claim 1, wherein a gap is formed in the magnetic core, and a capacitor is provided in the gap.

7. The inductor according to claim 6, wherein the gap is formed in an end part in a direction perpendicular to a direction of winding of the winding.

8. The inductor according to claim 6, wherein a rectifier is provided in the gap.

9. The inductor according to claim 1, wherein the magnetic core has:

a first core around which the winding is wound; and a second core provided on an end part of the first core in a direction perpendicular to a direction of winding of the winding, and the second core is disposed on the opposite side of the first core to the conductive plate.

10. An inductor, comprising:

a magnetic core;

a winding formed around the magnetic core;

a first resin provided between turns of the winding;

a second resin covering the winding and the first resin; and a tubular bobbin, wherein:

the second resin has higher filler content than the first resin, the magnetic core is inserted into a hold of the bobbin, the winding is wound around the bobbin, and a conductive material having lower rigidity than the bobbin and the magnetic core is provided between the bobbin and the magnetic core.

11. The inductor according to claim 10, wherein recesses and projections are formed on an outer periphery of the bobbin, and the winding is disposed in the recesses.

* * * * *